US006196928B1

(12) United States Patent
Jäger

(10) Patent No.: US 6,196,928 B1
(45) Date of Patent: Mar. 6, 2001

(54) PLASTIC PIN AND METHOD OF MAKING SAME

(76) Inventor: Arnold Jäger, Gehrbergsweg 6, D-31303, Burgdorf (DE)

( * ) Notice: Subject to any disclaimer, the term of this patent is extended or adjusted under 35 U.S.C. 154(b) by 0 days.

(21) Appl. No.: 09/378,122

(22) Filed: Aug. 19, 1999

(51) Int. Cl.[7] ..... A63D 9/00
(52) U.S. Cl. ..... 473/118; 473/119
(58) Field of Search ..... 473/118, 119, 473/120, 124

(56) References Cited

U.S. PATENT DOCUMENTS 5,510,067 * 4/1996 Jager et al. .
5,569,093 * 10/1996 Jager .
5,595,542 * 1/1997 Jager .
5,655,970 * 8/1997 Jager .

* cited by examiner

*Primary Examiner*—William M. Pierce
(74) *Attorney, Agent, or Firm*—Robert W. Becker & Associates

(57) ABSTRACT

A plastic pin, including a bowling pin, for bowling lanes, and a method of making same, are provided. The pin has a hard shell for surrounding a core of cellular and/or porous polymeric material. The shell defines a hollow interior and in a lower portion of the pin has a bulging portion, thereabove a reduced diameter portion and thereabove an again widening head. A separate insert member is insertable into the hollow interior of the shell into the region of the reduced diameter portion thereof to divide the hollow interior into two hollow chambers. The insert member has a conical outer contour, the smaller diameter end of which faces the head of the pin.

2 Claims, 1 Drawing Sheet

PLASTIC PIN AND METHOD OF MAKING SAME

BACKGROUND OF THE INVENTION

The present invention relates to a plastic pin, including socalled bowling pins, for bowling lanes, and also relates to a method of making such a pin. The pin has a hard shell and surrounds a core of cellular and/or porous polymeric material. The shell, and the hollow interior that it surrounds, are provided in the lower portion of the pin with a bulging portion, thereabove a reduced diameter portion, and thereabove an again widening head. Furthermore, in the region of the reduced diameter portion there is provided in the hollow interior a transverse wall that divides the hollow interior and has a venting hole.

The transverse wall makes it possible to fill only the lower portion of the hollow interior with the cellular and/or porous polymeric material, so that the upper portion of the hollow interior remains empty and contains merely air. This division of the hollow interior is advantageous for influencing the center of gravity and the tipping characteristic of the pin.

With the heretoforeknown pins of this type, the transverse wall extends monolithically from one wall of the shell to the opposite wall. The manufacture of such pins is therefore complicated, since the pin shell must practically contain two hollow chambers. See, for example, U.S. Pat. No. 5,569,093.

The present invention proceeds from the recognition that it would be advantageous if during formation of the pin shell such a shell could be made as a single piece, and that it is readily possible to provide in the base of the shell openings that can later be closed off and that are already required for introduction of the material that serves for filling the hollow interior.

It is therefore an object of the present invention to simplify the manufacture of the pin in such a way that a component that forms a transverse wall is introduced only after the shell has been formed or shaped.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
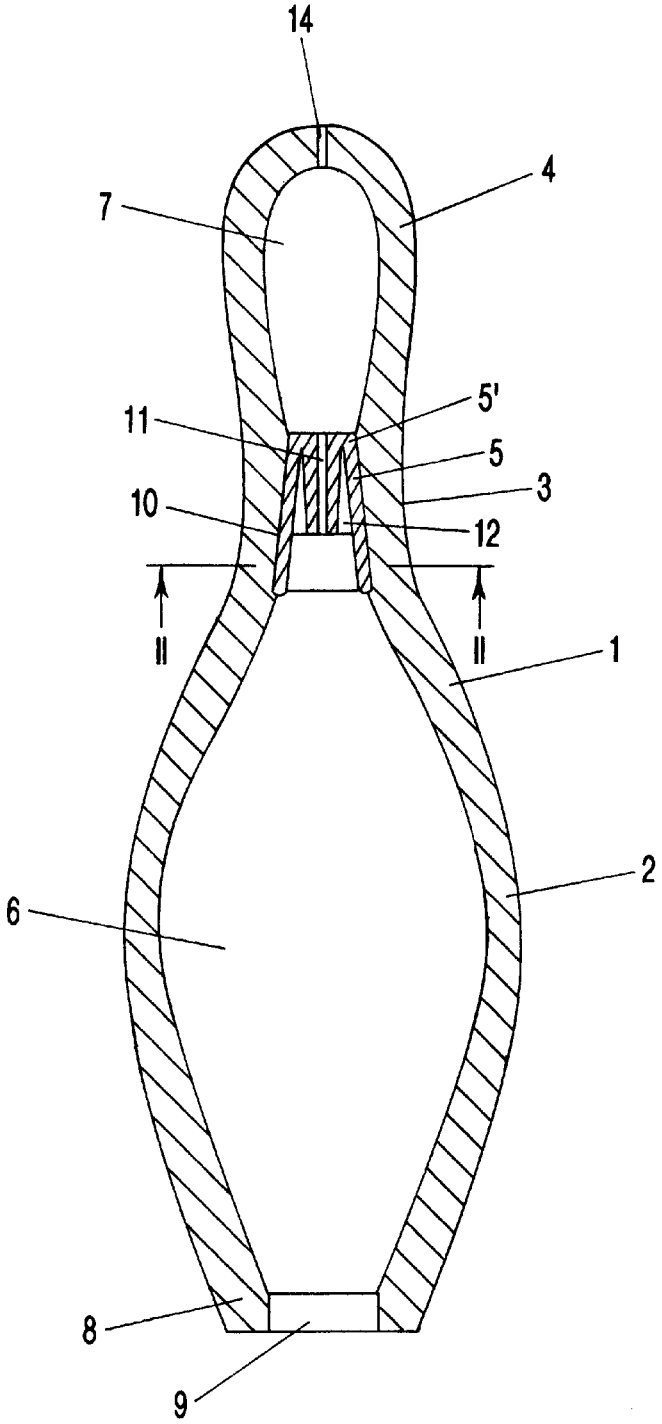
FIG. 1 is a longitudinal cross-sectional view through a blank or unfinished article for producing one exemplary embodiment of the inventive pin.
Figure 2:
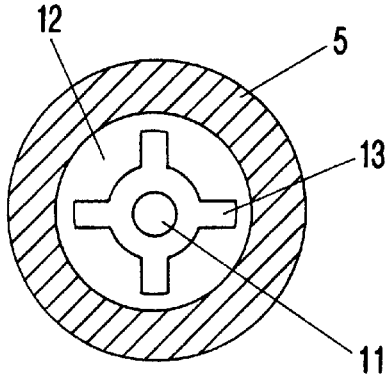
FIG. 2 is a cross-sectional view taken along the line II—II of FIG. 1 through the insert member of the blank of FIG. 1.

The pin of the present invention is characterized primarily in that the transverse wall is in the form of an insert member that can be introduced into the shell of the pin from below; the insert member has a conical configuration, in particular is frusto-conical, i.e. has a truncated cone configuration, with that end that has the smaller diameter being disposed adjacent to the head of the pin.

Pursuant to the inventive concept, first the shell, generally pursuant to a blow molding process, and the insert member are each separately produced, whereby the insert member obtains the aforementioned conical figuration, and is a molded member of polymeric material, for example a polyamide.

After the shell has been produced, for example pursuant to a blow molding process, and has become rigid in its shape, the insert member is introduced from below through an opening in the base of the shell into the lower hollow chamber thereof, and in particular in such a way that the smaller diameter end of the insert member faces the head of the pin shell and passes into the reduced diameter portion of the hollow interior of the shell. A fixed holding of the insert member in position can be achieved in particular if the material for the shell has not yet set completely and the shell is still disposed in the mold, for example the blow mold. By utilizing these method steps, a strong bond of the insert member relative to the wall of the shell is achieved, while at the same time preventing the shell of the pin from being deformed when the conical insert is forced into the reduced diameter portion of the shell.

Once the shell of the pin that is to be produced and that is provided with the insert member has become entirely rigid in shape, but as the case may be is still present in the support mold, the material that is provided with an expansion agent, and is for example based on polypropylene and possibly also contains glass fibers, is introduced from below into the shell, and in particular via the opening in the base through which the insert member was also introduced.

As a result of the core material that is introduced in this manner, the lower portion of the hollow interior of the shell that surrounds the bulging portion is filled with the expanding core material. In this connection, the air that is displaced can escape upwardly via the venting hole in the insert member, and in particular into the hollow chamber disposed above the insert member. From there, the air is conducted to the outside, for example via a small hole in the shell.

As a result of the foregoing procedure, in the finished pin only that hollow chamber disposed in the lower portion of the pin is filled, thus ensuring a specific tipping characteristic of the pin.

Further specific features of the present invention will be described in detail subsequently.

DESCRIPTION OF PREFERRED EMBODIMENTS

Referring now to the drawing in detail, the contour of the pin is determined by its shell 1, which is hard and impact resistant. It is made of a suitable plastic, especially a plastic having a polyamide base, and is produced by blow molding. For this purpose, among other things a mold is used that imparts to the shell a contour that is typical for a pin. Thus, in the bottom portion the shell 1 has a barrel or bulging portion 2, thereabove a neck or reduced diameter portion 3, and at the upper end a head 4. An insert member 5, which is in the form of a molded component having a polyamide base, and which is disposed in the region of the neck 3, results in the provision of a lower hollow chamber 6 that for all practical purposes is delimited by the bulging portion 2. Disposed above the insert member 5 in the region of the head 4 is an upper hollow chamber 7. It should be noted that the thickness of the wall of the shell 1 in the region of the greatest diameter of the bulging portion 2 is at its least. In contrast, the thickness of the wall of the shell 1 increases in the direction of the base 8 of the pin and also in the direction of the head 4.

Disposed in the base 8 of the blank or unfinished shell 1 is an opening 9 that is later closed to finish the pin; the opening 9 has a diameter that is slightly greater then the outer diameter of the insert member 5. This opening 9 also enables the introduction of the material for the non-illustrated core, which is made of cellular or porous material.

The separately made insert member 5, which is comprised of a polyamide or the like, has a conical outer surface 10, especially in the form of a truncated cone, and a centrally disposed venting hole 11. The lower end of the insert member 5 is hollow; for reasons of weight, recessed areas 12 are also provided that are disposed in the lower part of the material that surrounds the venting hole 11.

The insert member 5 is disposed in the region of the neck 3; its narrower or smaller diameter end 5' faces the head 4, and its conical outer contour is adapted to the inner contour of the unfinished shell that leads to the neck or narrow portion 3. The stability of the insert member 5 is increased in the upper portion by radially extending ribs 13 that delimit the recessed areas 12.

The shell 1 is produced by a blow molding process using a mold. The insert member 5 is then introduced through the opening 9 into the hollow chamber 6 and is inserted to the level of the neck 3, and in particular in such a way that with the material for the shell 1 not yet being set or hardened, a positive connection and/or a bond results between the insert member 5 and the material of the shell 1 in order in this manner to ensure a fixed positioning of the insert member 5 within the shell 1.

Plastic material, to which has been added an expansion agent, is then introduced into the hollow chamber 6 via the opening 9, which is thereafter closed off.

The material introduced into the hollow chamber 6 can, however, only fill that space within the shell that is delimited toward the top by the insert member 5, since this member forms a desired obstruction. During the expansion of the aforementioned material, the air is displaced through the venting hole 11 and out of the head 4 via a central hole 14 that is provided therein and that is closed off after the pin is finished.

It should be noted that insertion of the insert member 5 is preferably carried out while the shell 1 is still supported on its outer surface by its mold and the material of the shell is still slightly deformable during insertion of the insert member 5. As a consequence, a satisfactory and/or complete abutment of the outer surface 10 of the insert member 5 results, and possibly even a chemical bonding if a suitable selection of material for the shell 1 and the insert member 5 was undertaken. Furthermore, the conicity of the outer surface 10 of the insert member 5 is kept so slight that even with very large forces the insert member 5 cannot be pushed back into the chamber 6, quite apart from the fact that the material of the core is disposed in this chamber.

The present invention is, of course, in no way restricted to the specific disclosure of the specification and drawing, but also encompasses any modifications within the scope of the appended claims.

What I claim is:

1. A plastic pin, including a bowling pin, for bowling lanes, comprising:

a hard shell for surrounding a core of cellular and/or porous polymeric material, wherein said shell defines a hollow interior and in a lower portion of said pin has a bulging portion, thereabove a reduced diameter portion, and thereabove an again widening head; and a separate insert member that is insertable into said hollow interior of said shell in the region of said reduced diameter portion thereof to divide said hollow interior into two hollow chambers, wherein said insert member has a conical outer contour, a smaller diameter end of which faces said head of said pin, said insert member having a centrally disposed venting hole surrounded by a material, wherein said insert member is hollow in a lower end, said insert member including a plurality of recessed areas disposed in at least a portion of the material that surrounds the venting hole, said recessed areas delimited by radially extending ribs, wherein said insert is retained in said shell in a fixedly bonded and/or positively engaging manner, wherein a side of said insert member that faces said head is compact or essentially solid and wherein said insert member has a frusto-conical configuration.

2. A plastic pin according to claim 1, wherein at least portions of said insert member, on a side facing away from said head, are hollow.

* * * * *